United States Patent [19]

Anderson et al.

[11] 4,421,664

[45] Dec. 20, 1983

[54] COMPATIBLE ENZYME AND OXIDANT BLEACHES CONTAINING CLEANING COMPOSITION

[75] Inventors: Charles R. Anderson, Apple Valley; Thomas R. Oakes, Stillwater, both of Minn.

[73] Assignee: Economics Laboratory, Inc., St. Paul, Minn.

[21] Appl. No.: 389,617

[22] Filed: Jun. 18, 1982

[51] Int. Cl.[3] ..... C11D 3/395; C11D 7/42; C11D 7/54

[52] U.S. Cl. ..... 252/94; 252/95; 252/105; 252/174.12; 252/174.13

[58] Field of Search ..... 252/99, 95, 105, 174.12, 252/174.13, DIG. 12, 94, 89.1

[56] References Cited

U.S. PATENT DOCUMENTS

| | | | |
|---|---|---|---|
| 2,895,916 | 7/1959 | Milenkevich et al. | 252/99 |
| 3,154,494 | 10/1969 | Speak et al. | 252/174 |
| 3,650,961 | 3/1972 | Hudson | 252/99 |
| 3,703,470 | 11/1972 | Brennan | 252/99 |
| 3,706,670 | 12/1972 | Gray | 252/95 |
| 3,741,901 | 6/1973 | Ziffer | 252/89 |
| 3,755,085 | 8/1973 | Tlvin et al. | 195/68 |
| 3,799,879 | 3/1974 | Franeke et al. | 252/89 |
| 3,893,954 | 7/1975 | Tivin | 252/548 |
| 3,908,045 | 9/1975 | Alterman et al. | 427/213 |
| 4,001,132 | 1/1977 | Maguire, Jr. | 252/105 |
| 4,011,169 | 3/1977 | Diehl et al. | 252/95 |
| 4,078,099 | 3/1978 | Mazzola | 427/213 |
| 4,090,973 | 5/1978 | Maguire, Jr. et al. | 252/89 |
| 4,101,457 | 7/1978 | Place et al. | 252/559 |
| 4,115,292 | 9/1979 | Richardson et al. | 252/90 |
| 4,124,734 | 11/1978 | Alterman et al. | 428/403 |
| 4,126,717 | 11/1978 | Mazzola | 427/220 |
| 4,136,052 | 1/1979 | Mazzola | 252/94 |
| 4,176,079 | 11/1979 | Guerry et al. | 252/90 |
| 4,279,764 | 7/1981 | Brubaker | 252/99 |
| 4,327,151 | 4/1982 | Mazzola | 428/407 |

FOREIGN PATENT DOCUMENTS 6814295 4/1969 Netherlands .

OTHER PUBLICATIONS

"Microencapsulation: A Dynamic Product Delivery System", Battelle Technical Inputs to Planning/Report No. 6.

*Primary Examiner*—John E. Kittle
*Assistant Examiner*—Mukund J. Shah
*Attorney, Agent, or Firm*—Merchant, Gould, Smith, Edell, Welter & Schmidt

[57] ABSTRACT

Stabilized cleaning compositions comprise a biochemical soil degrading enzyme, a slow release oxidant bleach composition and an effective amount of a reducing agent to prevent the appearance of an enzyme deactivating concentration of oxidant bleach composition permitting the enzyme to degrade biochemical soils before bleaching action begins.

18 Claims, No Drawings

COMPATIBLE ENZYME AND OXIDANT BLEACHES CONTAINING CLEANING COMPOSITION

FIELD OF THE INVENTION

The invention relates to cleaning compositions containing oxidant bleaches and enzyme compositions.

BACKGROUND OF THE INVENTION

Enzymes have become an important component of a variety of cleaning compositions in view of their unique ability to degrade and promote removal of biological soil residues. Enzymes are biological catalysts which, among other properties, can cause a biochemical reaction which can break down biochemical substances. Enzymes are high molecular weight proteins that can have associated nonprotein structures. The biochemical reactions occur on the surface of the enzyme at a location called an "active site".

Proteinaceous, lipid (fatty) and polysaccharide materials can often be substantially insoluble in cleaning media. The high molecular weight of the materials prevents their efficient removal by common cleaning compositions. Proteolytic, lipolylic and amylolitic enzymes, by cleaving high molecular weight proteins, at peptide bonds within the protein, by cleaving polysaccharides, at glycosidic bonds within the polysaccharide and by cleaving fats or lipids at ester bonds, can reduce the high molecular weight soil compositions to low molecular weight monomeric or oligomeric compositions readily soluble in cleaning media. These enzymes have the substantial benefit that in view of their biological specificity the enzymes attack only the peptide, polysaccharide or lipid bonds and commonly do not chemically affect the material to be cleaned, leaving it strong, without holes or other damage caused by many cleaning compositions.

Oxidant bleaching compositions are useful compounds in cleaning compositions since their oxidizing nature can help to remove stains. Many stains are undesirable in view of the color that articles can derive from the presence of the staining material. The color of the stains is often derived from a complicated organic molecule having a variety of reactive or unsaturated groups and bonds. The oxidant bleaches attack the complicated organic molecule and its functional groups and bonds and oxidize it to less complicated organic molecules which are commonly colorless.

Enzyme-containing cleaning compositions have one major drawback. The enzymes can be substantially instantly deactivated by the presence of very small amounts of common bleaches such as peroxy-acids, chlorine, hypochlorite, dichloro isocyanurate, or other chlorine- or oxygen-yielding oxidizing bleach compositions. See U.S. Pat. No. 4,101,457, column 2, lines 38–41 and *Detergent Age,* Sept. 1968, Dr. Howard E. Wane. The oxidizing agents can attack the enzyme which degrades the biochemical soil composition, rendering the enzyme inactive. While we do not know how the oxidizing compounds deactivate the enzyme we know that some enzymes can be deactivated by chemically changing the nature of the enzyme-active site, by taking up space on the enzyme surface needed to bind a biochemical soil molecule, or by changing the shape of the enzyme molecule so that the active site can no longer degrade the biochemical substance. The deactivation of the enzyme by the chlorine or chlorine-yielding oxidizing bleach compositions apparently is, for all practical purposes instantaneous and occurs when any substantial concentration of chlorine or oxygen-containing bleach composition appears in solution, and occurs before any substantial soil removal can occur. We have measured deactivating amounts of chlorine which can comprise as little as 1 part of chlorine in one million parts of cleaning media.

One attempt to prevent oxidant bleach induced enzyme deactivation involves the encapsulation of the oxidant. The encapsulation is designed to delay the appearance of the enzyme inactivating concentration of oxidant composition. The appearance of oxidant from inside the capsule into the solution should be delayed by the diffusion process. However, this technique has been a practical failure since the enzymes can be deactivated by very small concentrations of oxidant which appears almost instantaneously from the capsules. Encapsulated chlorine bleaches contain some free oxidant-compound which either is not encapsulated or is derived from capsules that have been crushed and have released the chlorine compound.

Another attempt to stabilize enzymes in cleaning compositions includes the use of polysaccharides (U.S. Pat. No. 4,011,169), the use of nonionic polymers (M. Cherba, *EXPERIENTA,* No. 27,7, pp. 767–68), or attaching the enzyme to an insoluble support (Lilly, *The Chemical Engineer,* Jan–Feb 1968, pp. 12–18). These stabilization processes while providing a versatile enzyme composition cannot fully protect the enzyme from the inactivating effects of oxidizing bleaches.

The incompatibility of oxidizing bleaches and biochemical soil cleaving enzymes is a substantial problem since the combination of these cleaning agents would provide an important combination of properties. While bleaches can oxidize colored stains to colorless compounds and remove short chain material, bleaches cannot remove significant amounts of high molecular weight biochemical soil. Further, enzyme containing compositions cannot remove many highly colored soils since they are often low molecular weight nondegradable materials that become chemically or physically associated within the underlying material.

Accordingly, a substantial need exists to provide a composition which combines an enzyme and an oxidizing or oxidant bleach in such a way that the enzymes can degrade biochemical soil and the bleach can remove color.

Tlvin, U.S. Pat. No. 3,755,085 teaches the use of a chlorine scavenger to react with residual chlorine in the municipal water supply in order to prevent enzyme deactivation by the chlorine. Tlvin teaches that low levels of chlorine (i.e. 0.4 ppm and less), resulting from municipal chlorination of the water supply to kill pathogenic microorganisms, can inhibit enzyme activity. The low level of chlorine can be removed by contacting the water with about equivalent amounts of a chlorine scavenger prior to contacting the water with the enzyme composition and the soiled articles. This method is not helpful since no bleaching action can be derived from a composition in which all the chlorine is completely removed. Further the chlorine concentration taught in Tlvin is insufficient to produce a bleaching effect even if the scavenger were not used. Still further no mention is made of an encapsulated chlorine sources. This is not surprising since no bleaching action is desired or expected from chlorine in Tlvin.

Maguire, U.S. Pat. No. 4,001,132, issued Jan. 4, 1977 teaches a bleach free, enzyme free granular detergent composition for use in automatic dishwashers containing sulfite and sulfate. Sulfite is a reducing agent, however the sulfite is not taught in this patent to protect an enzyme from the presence of inactivating amounts of chlorine.

We have found that enzyme activity can be maintained in the presence of an oxidant bleach for a sufficient amount of time to degrade biochemical soil by combining, in a cleaning composition, a suitable biochemical soil degrading enzyme, an encapsulated source of an oxidant bleach composition and a reducing agent which preferentially and instantaneously chemically reduces the oxidant composition to a nonoxidizing form, thus providing a substantial delay in the appearance of an inactivating concentration of oxidant compound, and permitting the enzyme to break down biochemical soil. Since the encapsulated oxidant source releases initially low concentrations of bleach oxidant compound, the reducing agent preferentially and instantaneously destroys the oxidant concentration before any substantial deactivation of the enzyme can occur. At such time as the reducing agent is entirely consumed by the slow release of the oxidant compound from the encapsulating material, the concentration increases and inhibits the enzyme only after a delay during which the enzyme has had an opportunity to degrade biochemical soil. The active concentration of oxidant bleach can then oxidize colored substances to a colorless form. In this way the cleaning composition derives activity from both enzyme and bleach.

Enzymes

Enzymes are used for many purposes in various fields where biochemical reactions occur. In general, an enzyme can be described as a catalyst capable of permitting a biochemical reaction to quickly occur and can be classified according to the type of reaction they catalyze. Enzymes have complex chemical structures which basically consist of high molecular weight polymers of amino-acids of different structure. All enzymes are proteins, although some are associated with non-protein groups. Enzymes involved in some oxidation-reduction reactions often contain a metallic group. Enzymes are characterized by a high specificity, that is to say, each enzyme can catalyze a single reaction of one substance or a very small number of closely related substances.

Examples of enzymes suitable for use in the cleaning compositions of this invention include lipases, peptidases, amylases (amylolytic enzymes) and others which degrade, alter or facilitate the degradation or alteration of biochemical soils and stains encountered in cleansing situations so as to either remove more easily the soil or stain from the fabric or object being laundered to make the soil or stain more removable in a subsequent cleansing step. Both degradation and alteration can improve soil removability. Well known and preferred examples of these enzymes are proteases, lipases and amylases. Lipases are classified as EC class 3, hydrolases, subclass EC 3.1, preferably carboxylic ester hydrolases EC 3.1.1. An example thereof are lipases EC 3.1.1.3 with the systematic name glycerol ester hydrolases. Amylases belong to the same general class as lipases, subclass EC 3.2, especially EC 3.2.1 glycoses hydrolases such as 3.2.1.1 alpha-amylase with the systematic name alpha-1,4-glucan-4-glucanohydrolase; and also 3.2.1.2, beta-amylase with the systematic name alpha-1,4-glucan maltohydrolase. Proteases belong to the same class as lipases and amylases, subclass EC 3.4, particularly EC 3.4.4 peptide peptido-hydrolases such as EC 3.4.4.16 with the systematic name subtilopeptidase A.

Obviously, the foregoing classes should not be used to limit the scope of the invention. Enzymes serving different functions can also be used in the practice of this invention, the selection depending upon the composition of biochemical soil, intended purpose of a particular composition, and the availability of an enzyme to degrade or alter the soil.

Lipases, sometimes called esterases, hydrolyze fatty soils. The main factors influencing the specificity of the enzyme are the lengths and shapes of the substantially hydrocarbon groups on either side of the ester link.

Lipases suitable for use herein include those of animal, plant, and microbiological origin. Although only a few studies on lipase distribution in plants have been conducted, suitable lipase enzymes are present in cambium, bark, and in plant roots. In addition, lipases have been found in the seeds of fruit, oil palm, lettuce, rice bran, barley and malt, wheat, oats and oat flour, cotton tung kernels, corn, millet, coconuts, walnuts, fusarium, and cucurbito.

Suitable lipases are also found in many strains of bacteria and fungi. For example, lipases suitable for use herein can be derived from Pseudomonas, Aspergillus, Pneumococcus, Staphylococcus, and Staphylococcus Toxins, Mycobacterium Tuberculosis, *Mycotorula Lipolytica,* and Sclerotinia microorganisms, and can be made using recombinant DNA manufacturing techniques.

Suitable animal lipases are found in the body fluids and organs of many species. Most organs of mammals contain lipases, but in addition, the enzymes are found in several digestive juices as well as in pancreatic juice. A preferred class of animal lipase herein is the pancreatic lipase.

Specific examples of the commercially-available lipase enzymes, suitable for use herein, the pH ranges of their optimum activity, and the source appear in Table I.

TABLE I

| *Lipase | pH Range of Lipolytic Activity | Source |
|---|---|---|
| Remyzyme PL-600 | 7–11 | Pancreatic Juice |
| Astra | 7–10 | Microbial |
| Nacase | 7–9 | Microbial |
| Lipase YL | 7–9 | Microbial |
| Wallerstein AW | 7–9 | Fungal |
| Amano M-AP | 6–8 | Fungal |
| Meito MY-30 | 6–8 | Fungal |
| Amano CE | 8–10 | Microbial |
| Amano CE-50 | 7–10 | Microbial |
| Amano AP-6 | 6–8 | Fungal |
| Takedo 1969-4-9 | 6–8 | Microbial |

*Designated by commercial source

Lipases can be employed in the present cleaning compositions in an amount from about 0.005% to about 10%, preferably from 0.01 to 5% of the cleaning composition, on a pure enzyme basis. In cleaning media, the concentrations employed are dependent upon the particular enzyme used and the conditions of solution, such as pH, temperature, and period of pre-soak and wash, however concentrations in the range of from about 1 ppm to about 1000 ppm, preferably from about 5 ppm to about 500 ppm, are employed.

The amylolytic enzymes which can be stabilized and enhanced in the cleaning composition embodiment can be of fungal, plant, animal or bacterial origin and can be made using recombinant DNA manufacturing techniques. Suitable amylolytic enzymes including alpha- and beta-amylases. By way of example, suitable alpha-amylases of mold origin including those derived from *Aspergillus oryzae, Aspergillus niger, Aspergillus alliaceus, Aspergillus wentii,* and *Pencillium glaucum.* The alpha-amylases deried from cereal grains, pancreatic sources and such bacteria as *Bacillus subtilis, Bacillus macerans, Bacillus mesentericus* and *Bacillus thermophilus* are also useful herein. These enzymes are active in the pH range of from about 4.5 to about 12 and, depending upon the species, at temperatures including laundering temperatures, i.e. up to about 200° F.

Preferred amylolytic enzymes herein are the alpha-amylases derived from the bacterial organism *Bacillus subtilis.* These amylases provide excellent desizing and starch digestive properties and are especially useful in the laundering of textile materials containing soils and stains of a starchy nature.

The amylolytic enzymes useful herein can be employed in a pure state. Generally, they are employed in the form of a powdered commercially available preparation wherein the amylolytic enzyme is present in an amount of from about 2 to about 80% of the preparation. The remaining portion, i.e. about 20% to about 98%, comprises inert vehicle such as sodium sulfate, calcium sulfate, sodium chloride, clay or the like. The active enzyme content of these commercial enzyme compositions is the result of manufacturing methods employed and is not critical herein so long as the finished compositions of this invention have the hereinafter specified enzyme content. Specific examples of commercial enzyme preparations suitable for use herein and the manufacturers thereof including: Diasmen alpha-amylase (Daiwa Kasei KK, Tokyo, Japan); Rapidase alpha-amylase (Novo Industri, Copenhagen, Denmark), Wallerstein alpha-amylase (Wallerstein Company, Staten Island, N.Y.); Rhozyme-33 and Rhozyme H-39 (Rohm & Haas Philadelphia, Pa.).

The amylolytic enzymes can be employed in the cleaning composition embodiment of this invention in an amount from about 0.005% to about 12%, preferably from 0.01% to 5% of the composition on a pure enzyme basis.

Suitable proteolytic enzymes for use in the detergent composition embodiment can be of vegetable, animal bacterial, mold and fungal origin, and can also be derived from recombinant DNA manufacturing techniques.

The proteolytic enzyme can be employed in the compositions of the present invention in an amount of 0.005% to about 3%, on a pure enzyme basis. Best results in terms of overall cleaning efficacy and stain-removing properties are attained when the proteolytic enzyme is employed in an amount of about 0.01% to about 1% on a pure enzyme basis.

Specific examples of proteases suitable for use are trypsin, collagenase, keratinase, elastase, subtilisin, BPN and BPN'. Preferred proteases are serine proteases produced from microorganisms such as bacteria, fungi or mold. The serine proteases which are procured by mammalian systems, e.g. pancreatin, are also useful herein.

Specific examples of commercial products and the manufacturer thereof include: Alcalase or Esperase, Novo Industri, Copenhagen, Denmark; Maxatase, Koninklijke, Nederlandsche Gist-En Spiritusfabriek N.V., Delft, Netherlands; Protease B-4000 and Protease AP, Schweizerische Ferment A.G., Basel, Switzerland; CRD-Protease, Monsanto Company, St. Louis, Mo.; Viokase, BioBin Corporation, Monticello, Ill.; Pronase-P, Pronase-E, Pronase-AS and Pronase-AF all of which are manufactured by Kaken Chemical Company, Japan; Rapidase P-2000, Rapidase Seclin, France; Takamine, HT proteolytic enzyme 200, Enzyme L-W (derived from fungi rather than bacteria), Miles Chemical Company, Elkhart, Ind.; Rhozyme P-11 concentrate, Rhozyme PF, Rhozyme J-25, Rohm & Haas, Philadelphia, Pa. (Rhozyme PF and J-25 have salt and corn starch vehicles and are proteases having diastase activity); Amprozyme 200, Jacques Wolf & Company, a subsidiary of Nopco Chemical Company, Newark, N.J.; Takeda Fungal Alkaline Protease, Takeda Chemical Industries, Ltd., Osaka, Japan; Wallerstein 201-HA, Wallerstein Company, Staten Island, N.Y.; Protin AS-20, Dawai Kasei K.K., Osaka, Japan; and Protease TP (derived from thermophilic Streptomyces species strain 1689), Central Research Institute of Kikkoman Shoya, Noda Chiba, Japan.

REDUCING AGENTS

Reducing agents useful to prevent the appearance of an enzyme deactivating concentration of oxidant bleach compound include reducing agent that can substantially reduce $Cl_2$, HClO and other oxidizing chlorine containing compositions to $Cl^{\ominus}$ ions or can substantially reduce hydrogen peroxide or peroxy acid bleaches to unoxidized species. The reducing agent should not damage the object or material to be cleaned or substantially chemically change the enzyme, or other cleaning composition components such as the detergent, builder, etc.

Useful reducing agents include reducing sulfur-oxy acids and salts thereof. Most preferred for reasons of availability, low cost, and high performance are the alkali metal and ammonium salts of sulfur-oxy acids including ammonium sulfite ($(NH_4)_2SO_3$), sodium sulfite ($Na_2SO_3$), sodium thiosulfite ($Na_2S_2O_3$), sodium metabisulfite ($Na_2S_2O_3$), potassium metabisulfite ($K_2S_2O_5$), lithium hydrosulfite ($Li_2S_2O_4$), etc.

SLOW RELEASE OXIDANT BLEACH

The slow release oxidant compositions of this invention include those compounds that release active oxidizing species at a rate such that the maximum concentration required for bleaching action does not appear for at least one minute. A useful class of slow release oxidant compositions include compounds having a rate of dissolution such that the maximum concentration is not released at once. Another useful class of oxidant compounds includes compositions having additional components that reduce the rate the oxidant concentration appears in solution.

Encapsulated oxidant compounds are useful slow release compositions and comprise an encapsulating coating and an oxidant compound or an oxidant-yielding compound wherein the coating surrounds the compound and presents a barrier to the diffusion of the compound thus releasing the compound slowly.

The encapsulation of compounds is well known technology. A great number of coating compounds can be used to encapsulate the chlorine compounds. Examples of useful coatings include high molecular weight semi-solid and solid fats, inorganic solids, synthetic and natural resins, etc. The coatings can be applied in a variety of well known methods including tumbling the coating and coated compound in a rolling mill, spraying a solution or suspension of the coating onto a fluidized bed of the compound to be coated, precipitating the coating from a solvent onto the compound to be coated which is in suspension in the solvent, etc.

CHLORINE BLEACH

One class of slow release oxidant compounds are chlorine-releasing, active-chlorine or chlorine-yielding substances or compositions, suitable for use in slow release chlorine compositions, including compounds capable of having their chlorine liberated in the form of free chlorine ($Cl_2$) or hypochlorite ($OCl^-$) under conditions normally used for bleaching purposes. Alkali metal dichloroisocyanurate including potassium dichloroisocyanurate, sodium dichloroisocyanurate, chlorinated trisodium phosphate, an alkali metal or alkaline earth metal hypochlorite, including calcium or lithium hypochlorite, monochloramine, dichloramine, nitrogen trichloride [(mono-trichloro)-tetra-(mono-potassium dichloro)]penta-isocyanurate, 1,3-dichloro-5,5-dimethyl hydantoin, paratoluene sulfondichloroamide, trichloromelamine, N-chloromelamine, N-chlorosuccinimide, N,N'-dichloroazodicarbonamide, N-chloro acetyl urea, N,N'-dichlorobiuret, chlorinated dicyandiamide, trichlorocyanuric acid, and dichloroglycoluril can be used.

Alkali metal dichloroisocyanurate, typical of the cyanurates suitable as core substances, is commercially available and may be obtained from the Monsanto Chemical Company. The chemical structure of this compound may be represented by the formula

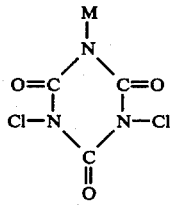

wherein M is an alkali metal. Information regarding this and related compounds may be found in Monsanto Technical Bulletin 1-177. Potassium dichloroisocyanurate, while not preferred, may also be employed.

Additional chlorinated compounds of the type referred to in the instant specification as chlorine-releasing agents, which liberate elemental chlorine under the conditions of use set forth herein, are well known in the detergent, bleaching and sanitizing arts. Disclosures of typical chlorine-releasing agents, preparative procedures, and use in combination with certain detergents and additives may be found collectively in the following list of patents, which is by no means exhaustive. U.S. Pat. Nos. 1,555,474, 1,950,956, 1,965,304, 2,929,816, 3,035,054, 3,035,056, 3,035,057, 3,110,677, and 3,346,502.

Suitable chlorine-releasing agents are also disclosed in the ACS Monogran entitled "Chlorine—Its Manufacture, Properties and Uses" by Sconce, published by Reinhold in 1962.

PEROXY BLEACH

Another class of oxidant compounds that can be used in slow release form is the peroxy bleach compound.

The peroxy bleach compound can be represented by all usual highly oxidized inorganic and organic ingredients which can be satisfactory for being incorporated for bleaching in detergent compositions.

Inorganic peroxy bleach compounds in which the alkaline metal salts of perborates, percarbonates, persilicates, persulfates, and perphosphates. As is well known, the perborates can have different degrees of hydration. Although frequently the tetrahydrate form is used, it is for certain purposes desirable to incorporate the perborates having a lower degree of hydration water, for example, one mole, two moles, or three moles.

Organic peroxy bleach agents may be used as well. The organic peroxy bleaches can be prepared previously or they can be prepared in situ through the addition of, for example, any peroxy bleach agents suitable for being used in combination with an organic peroxy-bleach activator.

Specific examples of the organic peroxy-bleach compounds are the $C_{1-24}$ aliphatic and aromatic mono- and diperoxy acids such as peracetic acid, percaproic acid, peroleic acid, pertetracosenoic acid, peroxalic acid, peradipic acid, perdodeacedoic acid, pertetrapenedioic acid, perazelaic acid, monoperoxyphthalic acid, diperoxy-terephthalic acid, 4-chlorodiperoxyphthalic acid. Preferred aromatic peracids include the water-soluble salts of diperisophthalic acid, m-chloroperbenzoic acid and p-nitroperbenzoic acid and their water soluble salts.

In the event the peroxy bleach compound is to be prepared in situ, then its precursors, i.e. the peroxy bleach agent and peroxygen activators are to be added separately to the detergent composition. The peroxygen bleach can be represented by all oxygen bleaching agents which are commonly used in detergent technology, i.e., organic and inorganic species, as mentioned hereinbefore. The activating agents can be represented by all the oxygen activators known as being suitable for use in detergent technology. Specific examples of the preferred activators include acylated glycoluriles, tetra-acetyl methylene diamine, tetra-acetyl ethylene diamine, triacetyl isocyanurate and benzoylimidazole. Acid anhydride activators which bear at least one double bond between carbon atoms, in alpha,alpha' to the carbonyl group of the anhydride radical can be used as well. Examples thereof are phthalic and meleic anhydrides. Especially preferred bleach activators are based on aldehydes, ketones, and bisulfite adducts of aldehydes and ketones. Examples of these especially preferred activators include: 1,4-cyclohexanedione; cyclohexanone; 3-oxo-cyclohexylacetic acid; 4-tertbutylcyclohexanone; 5-diethylmethylammonio-2-pentanone nitrate; N-methyl-morpholinioacetophenone nitrate; acetone, methyl ethyl ketone; 3-pentanone; methylpyruvate; N-methyl-4-oxopiperidine oxide; 1,4-bis(N-methyl-4-oxo-piperidineiomethyl)benzene chloride; N-methyltropinonium nitrate; 1-methyl-4-oxo-tetrahydrothiapyranonium nitrate; N-benzyl-N-methyl-4-oxo-piperidinium nitrate; N,N-dimethyl-4-oxo-piperidinium nitrate; di-2-pyridyl ketone; and chloral hydrate.

In the event the peracid is prepared in situ, then the molar ratio of peroxygen bleach agent to bleach activator shall preferably be in the range from about 5:1 to 1:2, especially from 2:1 to 1:1.2. Other oxidizing bleaches can also be used.

Surfactants

The compositions contemplated in the cleaning composition of this invention comprise from about 5% to about 99% of an organic surface-active agent selected from the group consisting of anionic, nonionic, zwitterionic and ampholytic detergents and mixtures thereof.

The detergent ingredient is preferably used in an amount from about 8% to about 99%. Examples of suitable organic detergents are anionic, nonionic, ampholytic and zwitterionic detergents and mixtures thereof, are described in U.S. Pat. No. 3,579,454, particularly column 11, line 45 to column 19, line 64, which is incorporated herein by reference.

Alkali metal alkyl benzene sulfonates, in which the alkyl group contains from about 9 to about 20 carbon atoms in straight chain or branched-chain configuration can be used including those described in U.S. Pat. Nos. 2,220,099 and 2,477,383 (especially valuable are linear straight chain alkyl benzene sulfonates in which the average of the alkyl groups is about 11.8 carbon atoms and commonly abbreviated as $C_{11.8}$LAS).

Another detergent for use herein includes alkyl ether sulfonates. These materials have the formula $RO(C_2H_4O)_xSO_3M$ wherein R is alkyl or alkenyl of about 10 to about 20 carbon atoms, x is 1 to 30, and M is a water-soluble cation such as alkali metal, ammonium and substituted ammonium. The alkyl ether sulfates useful in the present invention are condensation products of ethylene oxide and monohydric alcohols having about 10 to about 20 carbon atoms. Preferably, R has 14 to 18 carbon atoms. The alcohols can be derived from fats, e.g. coconut oil or tallow, or can be synthetic. Lauryl alcohol and straight chain alcohols derived from tallow are preferred herein. Such alcohols are reacted with 1 to 30, and especially 1 to 6, molar proportions of ethylene oxide and the resulting mixture of molecular species, having, for example, an average of 3 moles of ethylene oxide per mole of alcohol, is sulfated and neutralized.

Specific examples of alkyl ether sulfates of the present invention are sodium coconut alkyl ethylene glycol ether sulfate; sodium tallow alkyl triethylene glycol ether sulfate; and sodium tallow alkyl hexaoxyethylene sulfate.

Other preferred detergents utilizable herein are olefin sulfonates having about 12 to about 24 carbon atoms. The term "olefin sulfonates" is used herein to mean compounds which can be produced by the sulfonation of alpha-olefins, or a poly-alpha-olefin, by means of uncomplexed sulfur trioxide, followed by neutralization of the acid reaction mixture in conditions such that any sultones which have been formed in the reaction are hydrolyzed to give the corresponding hydroxy-alkanesulfonates. The sulfur trioxide can be liquid or gaseous, and is usually, but not necessarily, diluted by inert diluents, for example, by liquid $SO_2$, chlorinated hydrocarbons, etc., when used in the liquid form, or by air, nitrogen, gaseous $SO_2$, etc., when used in the gaseous form.

The alpha-olefins from which the olefin sulfonates are derived from mono-olefins having 2 to 24 carbon atoms, preferably 14 to 16 carbon atoms. Preferably, they are straight chain olefins of olefin polymers. Examples of suitable olefins include 1-dodecene; 1-tetradecene; 1-hexadecene; 1-octadecene; 1-eicosene and 1-tetracosene.

In addition to true alkane sulfonates and a portion of hydroxy-alkanesulfonates, olefin sulfonates can contain minor amounts of other materials, such as alkane disulfonates depending upon the reaction conditions, proportion of reactants, the nature of the starting olefins and impurities in the olefin stock and side reactions during the sulfonation process.

Specific alpha-olefin sulfonates for use in the present invention are described more fully in U.S. Pat. No. 3,332,880 of Phillip F. Pflaumer and Adriaan Kessler, issued July 25, 1967, titled "Detergent Composition", the disclosure of which is incorporated herein by reference.

It can also be desirable to add to the compositions of the detergent embodiment of the present invention a detergent builder component. These detergent builders are used at concentrations of from about 0% to about 60%, preferably 20% to 50% of the detergent composition. They can be represented by all detergent builder ingredients which are known to be suitable for use in detergent compositions. As regards their function, they serve to maintain the pH of the laundry solution in the range of from about 7 to about 12, preferably from about 8 to about 11. In addition, they enhance fabric cleaning performance in combination with the detergent surface-active ingredient. Other well-known functions of detergent builder salts relate to their capability for suspending particulate salts released from the surface of the fabric and also preventing redeposition on the fabric.

Suitable detergent builder salts useful herein can be of the poly-valent inorganic and poly-valent organic types, or mixtures thereof. Non-limiting examples of suitable water-soluble, inorganic alkaline detergent builder salts include the alkali metal carbonates, borates, phosphates, polyphosphates, tripolyphosphates, bicarbonates, silicates and sulfates. Specific examples of such salts include the sodium and potassium tetraborates, perborates, bicarbonates, carbonates, tripolyphosphates, orthophosphates and hexametaphosphates.

Examples of suitable organic alkaline detergency builder salts are (1) water-soluble amino polyacetates, e.g. sodium and potassium ethylenediamine tetraacetates, nitrilotriacetates and N-(2hydroxyethyl)nitrilodiacetates; (2) water-soluble salts of phytic acid, e.g. sodium and potassium phytates; (3) water-soluble polyphosphonates, including sodium, potassium and lithium salts of ethane-1-hyroxy-1,1-diphosphonic acid; sodium, potassium and lithium salts of methylenediphosphonic acid and the like.

Additional organic builder salts useful herein include the polycarboxylate materials described in U.S. Pat. No. 2,264,103, including the water-soluble alkali metal salts of mellitic acid. The water-soluble salts of polycarboxylate polymers and copolymers such as are described in U.S. Pat. No. 3,308,067, incorporated herein by reference, are also suitable herein. It is to be understood that while the alkali metal salts of the foregoing inorganic and organic poly-valent anionic builder salts are preferred for use herein from an economic standpoint, the ammonium, alkanolammonium, e.g. triethanolammonium, diethanolammonium, and the like, water-soluble salts of any of the foregoing builder anions are useful herein.

Mixtures of organic and/or inorganic builder salts can be used herein. One such mixture of builders is disclosed in Canadian Pat. No. 755,038, e.g. a ternary mixture of sodium tripolyphosphate, trisodium nitrilotriacetate and trisodium ethane-1-hydroxy-1,1-diphosphonate.

While any of the foregoing alkaline poly-valent builder materials are useful herein, sodium tripolyphosphate, sodium nitrilotriacetate, sodium melitate, sodium citrate and sodium carbonate are preferred herein for this builder use.

The cleaning composition of the invention can include other well-known agents including suds boosters, suds suppressing agents, tarnish inhibitors, soil suspending agents, buffering agents, optical brighteners, fluorescers, perfumes, dyes and corrosion inhibitors. The suds boosters can, e.g., be represented by diethanolamides. Silicones, hydrogenated fatty acid, and hydrophobic alkylene oxide condensates can be used in the like compositions for suds suppressing purposes or, more generally, for suds regulating purposes. Benzotriazole and ethylenethiourea can be used as tarnish inhibitors. Carboxymethyl celluose is a well-known soil suspending agent. The above additional ingredients, when used in the instant compositions, shall be employed in the usual ranges.

The detergent compositions of the instant invention can be of any physical state, i.e. aqueous or other liquid, pasty, powdered and granular. Highly preferred are solid, including powdered and granular, cleaning compositions.

The detergent compositions with which the encapsulated bleaching agents of the invention find utility may have compositions represented by the following components and ranges of proportions thereof.

TABLE II

| | Approximate Percentage (by weight) |
|---|---|
| Anionic or nonionic detergent | 1–90% |
| Builder | 0–90% |
| Encapsulated chlorine-containing compound | 2–25% |
| Enzyme | 0.001–10% |
| Reducing agent | 0–23% |

Detergent compositions formulated for use in the washing of fabrics in automatic washing machines may contain about 5 to about 30 percent anionic detergent, about 30 to about 60 percent of one or more of the builders mentioned hereinabove, and sufficient encapsulated bleaching agent to provide about 5–200 parts per million chlorine in the wash water, or approximately 2 to 25 percent of the agent in the detergent formulation. Optionally included are about 0.01–0.3 percent optical brightener, and if desired small proportions of other components such as germicides, anticaking agents, etc. to confer special properties on the product.

When the detergent is soap, and comprises the major proportion of the detergent-bleach product, the soap may be present in amounts from about 60 to about 90 percent little or no builder being required, although about 1 to about 10 percent of an alkaline builder may be advantageous.

When the detergent is nonionic, from about 5 to about 20 percent is suitable, the balance of the composition being as listed above.

Detergent compositions formulated for mechanical dishwashers and having the encapsulated bleaching agents of the invention therein may contain low proportions of nonionic detergent, for example about 1 to about 10 percent, and may contain a suds depressant and a high proportion of a builder, for example about 50--90 percent of a mixture of sodium tripolyphosphate, sodium carbonate, and sodium silicate.

The invention may be more fully understood by reference to the following examples which contain a preferred embodiment.

EXAMPLE I

Into a two-liter flask containing one liter of distilled water at 140° F. was added 2.5 grams of the detergent composition of Example X and 50 milligrams of ethylene vinyl acetate encapsulated potassium dichloroisocyanurate. The mixture in the flask was agitated and maintained at 140° F. using a heated stirring plate. Nine milliliter samples were withdrawn at convenient intervals and were titrated for available chlorine.

| Time | Available Chlorine ppm $Cl_2$ (Ave) |
|---|---|
| 15 seconds | 1 |
| 1 minute | 2 |
| 2 minutes | 3 |
| 3 minutes | 4 |
| 4 minutes | 5 |
| 5 minutes | 8 |
| 10 minutes | 12 |
| 15 minutes | 21 |
| 20 minutes | 27 |
| 25 minutes | 26 |

EXAMPLE II

Into a two-liter flask containing one liter of a 9 ppm solution of sodium bisulfite in water was added 50 mg of ethylene vinyl acetate encapsulated potassium dichloroisocyanurate capsules. At convenient time intervals 9 milliliters of solution was withdrawn through a 0.45 micron membrane filter. The samples were titrated for available chlorine.

| Time | Available Chlorine $Cl_2$ (ppm Ave) |
|---|---|
| 15 seconds | 0 |
| 1 minute | 0 |
| 2 minutes | 0 |
| 3 minutes | 0 |
| 4 minutes | 2 |
| 5 minutes | 4 |
| 7 minutes | 6 |
| 9 minutes | 7 |
| 11 minutes | 9 |
| 13 minutes | 10 |
| 15 minutes | 11 |

EXAMPLE III

Example II was repeated except that 3.45 grams of the detergent composition of Example X was added to the flask.

| Time | Available Chlorine $Cl_2$ (ppm Ave) |
|---|---|
| 15 seconds | 0 |
| 1 minute | 0 |
| 2 minutes | 0 |
| 3 minutes | 0 |
| 4 minutes | 3 |
| 5 minutes | 5 |
| 7 minutes | 7 |
| 9 minutes | 10 |
| 11 minutes | 12 |
| 13 minutes | 13 |

-continued

| Time | Available Chlorine $Cl_2$ (ppm Ave) |
|---|---|
| 15 minutes | 15 |

EXAMPLE IV

Example II was repeated with 75 milligrams of the encapsulated potassium dichloroisocyanurate, 2.425 grams of the detergent composition of Example X and 18 parts per million of sodium bisulfite.

| Time | Available Chlorine $Cl_2$ (ppm Ave) |
|---|---|
| 15 seconds | 0 |
| 1 minute | 0 |
| 2 minutes | 0 |
| 3 minutes | 3 |
| 4 minutes | 4 |
| 5 minutes | 6 |
| 7 minutes | 8 |
| 9 minutes | 12 |
| 11 minutes | 13 |
| 13 minutes | 16 |
| 15 minutes | 19 |

EXAMPLE V

Into a two-liter flask was placed 1000 milliliters of a 54 parts per million solution of sodium bisulfite at 140° F., 6.25 grams of the detergent composition of Example X, 0.25 grams of ethylene vinyl acetate coated potassium dichloroisocyanurate and 1 gram (3.97 KN units) of Esperase enzyme composition from Novo Industries. At convenient intervals an 11 milliliter sample of the contents of the flask was withdrawn with a disposable syringe. A membrane filter was attached to the syringe in order to remove any encapsulated chlorine composition. A 5 milliliter aliquot of this solution was diluted to 50 ml at pH 10.0 using an arginine buffer. This solution was analyzed for available chlorine and enzyme activity.

| Time | Available Chlorine (ppm) | Enzyme Activity (casien units) |
|---|---|---|
| Standard (0 time) | 0 | 17,553 |
| 15 seconds | 0 | 8,100 |
| 1 minute | 0 | 6,200 |
| 2 minutes | 0 | 2,600 |
| 3 minutes | 0 | 1,100 |
| 4 minutes | 5 | 100 |
| 5 minutes | 5 | 0 |
| 7 minutes | 12 | 0 |
| 9 minutes | 19 | 0 |
| 11 minutes | 22 | 0 |
| 13 minutes | 28 | 0 |

EXAMPLE VI

Into a commercial dishwasher was placed a 6×6 inch glass slide, 2 10 oz. glass tumblers and 2 stainless steel knives soiled with peanut butter and a tea-stained cup, along with unsoiled dishes. The dishwasher was run through a normal cycle. The dishwasher contained 22.8 grams of the detergent composition of Example X, 1.0 grams of Esperase enzyme, 1.0 grams of encapsulated potassium dichloroisocyanurate and 0.2 gm sodium thiosulfate. Both the peanut butter (protein and fatty soil) and the tea stain (highly colored bleachable soil) were removed.

EXAMPLE VII

Example V was repeated except that 0.2 grams of sodium thiosulfite was omitted. The peanut butter stain (protein and fatty soil) remained but the tea stain was removed.

EXAMPLE VIII 4.0 grams of a diperoxy acid bleach was added to 1 liter of distilled water and mixed until dissolved. One gram of Esperase (Novo Industries, 3.97 kilo novo units) was added and mixed and the activity of the enzyme was measured as about 9.5 units.

EXAMPLE IX

Example VIII is repeated without the diperoxy acid bleach. The enzyme activity was measured as 84000 units.

EXAMPLE X

A dry mixture comprising 35 wt-% sodium tripolyphosphate, 30 wt-% sodium carbonate, 14.5 wt-% sodium silicate solids, balance sodium sulfate was made.

An examination of the Examples shows that a measurable concentration of chlorine is formed within 15 seconds in a solution containing the encapsulated potassium dichloroisocyanurate (Example I). Adding 9 ppm of sodium bisulfite to the solution delays the appearance of chlorine for 3 minutes (Ex. II). The presence of detergent in the solution does not appear to change the delay (Examples III and IV). The activity of the enzyme Esperase is protected for up to 4 minutes against the effects of the chlorine concentration by the presence of sodium bisulfite (Example II). Examples III and VII show that the presence of the reducing agent sodium thiosulfate is necessary for the removal of both protein and fatty soil by the enzyme. Examples VIII and IX show that the diperoxy acid bleaches can also deactivate enzymes.

The foregoing specification and Examples provide a basis for understanding the invention. However, since many embodiments of the invention can be made without departing from the scope of the invention, the invention resides solely in the claims hereinafter appended.

We claim:

1. A cleaning composition, having a combination of bleaching action and enzymatic degradation of biochemical soils, which comprises a slow release oxidant bleach composition which delays the appearance of the full concentration of the oxidant bleach, said composition having a tendency to release a small enzyme deactivating amount of the oxidant, prior to the full concentration of the bleach being released, a biological soil degrading enzyme and an amount of a chemical reducing agent effective to delay the appearance of an enzyme deactivating concentration of oxidant bleach composition until the full concentration of the oxidant bleach composition is released.

2. The composition of claim 1 wherein the slow release oxidant bleach composition comprises an encapsulated oxidant bleach composition.

3. The composition of claim 2 wherein the encapsulated oxidant bleach composition comprises an encapsulated peroxy bleach.

4. The composition of claim 3 wherein the encapsulated peroxy bleach composition comprises an encapsulated organic peroxy bleach.

5. The composition of claim 4 wherein the encapsulated organic peroxy bleach comprises an encapsulated diperoxy acid bleach or an encapsulated water soluble salt of a diperoxy acid bleach.

6. The composition of claim 2 wherein the encapsulated oxidant bleach composition comprises an encapsulated chlorine or chlorine-yielding composition.

7. The composition of claim 6 wherein the encapsulated chlorine-yielding composition comprises an encapsulated chlorinated silicate metal phosphate, an alkali metal or alkaline earth metal hypochlorite, N-chlorosuccinimide or mixtures thereof.

8. The composition of claim 6 wherein the encapsulated chlorine-yielding composition comprises an encapsulated alkali metal dichloroisocyanurate.

9. The composition of claim 8 wherein the encapsulated alkali metal dichloroisocyanurate comprises encapsulated potassium dichloroisocyanurate.

10. The composition of claim 2 wherein the encapsulated oxidant bleach compound encapsulating material comprises a fatty acid, a natural wax, a synthetic resin, an inorganic coating or mixtures thereof.

11. The composition of claim 10 wherein the synthetic resin comprises an ethylene-vinyl acetate polymer.

12. The composition of claim 1 wherein the biological soil degrading enzyme comprises a proteolytic enzyme, a lipolytic enzyme, an amylolytic enzyme or mixtures thereof.

13. The composition of claim 1 wherein the chemical reducing agent comprises a composition that can reduce the oxidant bleach composition compound to a nonoxidizing species at a rate that an enzyme deactivating concentration of oxidant does not appear in solution for at least one minute.

14. The composition of claim 1 wherein the chemical reducing agent comprises an alkali metal sulfite, an alkali metal thiosulfite, an alkali metal metabisulfite, an alkali metal hydrosulfite, or mixtures thereof.

15. The composition of claim 1 wherein the chemical reducing agent comprises sodium metabisulfite.

16. The composition of claim 1 wherein there is an additional component comprising an anionic detergent, a nonionic detergent or mixtures thereof.

17. The composition of claim 16 wherein there is an additional component comprising a detergent builder, a suds suppressor or mixtures thereof.

18. A method of cleaning which comprises contacting a soiled article with an aqueous solution of the cleaning composition of claim 1.

* * * * *